United States Patent [19]

Ellis

[11] 3,956,437

[45] May 11, 1976

[54] METHOD AND APPARATUS FOR CASTING A CONCRETE COLUMN

[76] Inventor: Joseph O. Ellis, 3741 Crown Shore Drive, Dallas, Tex. 75234

[22] Filed: Nov. 7, 1974

[21] Appl. No.: 521,742

Related U.S. Application Data

[63] Continuation-in-part of Ser. No. 379,368, July 16, 1973, abandoned, which is a continuation-in-part of Ser. No. 347,445, April 3, 1973, abandoned, which is a continuation-in-part of Ser. No. 162,573, July 14, 1971, abandoned.

[52] U.S. Cl. ..... 264/40; 249/49; 249/53 R; 249/157; 264/32; 264/219; 264/333

[51] Int. Cl.[2] ..... E04G 13/02

[58] Field of Search ..... 249/49, 51, 53, 164, 249/173, 157; 220/76, 79; 138/162, 166; 264/316, 32, 40, 219, 333

[56] References Cited

UNITED STATES PATENTS

| | | | |
|---|---|---|---|
| 562,697 | 6/1896 | Avery | 138/166 |
| 581,414 | 4/1897 | Cressler | 138/166 |
| 739,600 | 9/1903 | Heinig | 138/166 |
| 1,050,816 | 1/1913 | Deslauriers et al. | 249/173 |
| 1,154,972 | 9/1915 | Carlson | 249/173 |
| 1,601,379 | 9/1926 | Swan | 249/51 |
| 1,837,092 | 12/1931 | Almquist | 249/173 |
| 1,983,989 | 12/1934 | Pallas | 138/166 |
| 3,357,457 | 12/1967 | Myer | 138/166 |
| 3,806,078 | 4/1974 | Achzehner | 425/803 |
| 3,807,457 | 4/1974 | Logsdon | 220/266 |

*Primary Examiner*—J. Howard Flint, Jr.
*Assistant Examiner*—John McQuade
*Attorney, Agent, or Firm*—Wood, Herron & Evans

[57] ABSTRACT

A reusable column mold particularly adapted for use in casting concrete pillars or columns, that mold including a sheet of flat, flexible material which can be rolled into a columnar configuration to erect the mold form and which can be readily stripped from a set-up concrete column cast into the mold form. In preferred form, the flat sheet is of a rectangular configuration and is characterized by a plurality of tongues on one side edge which, when the sheet is rolled into columnar configuration, are adapted to fit into slots in the sheet located on one of a series of slot lines (the slot lines are parallel to the sheet's tongued side edge and are positioned intermediate the sheet's side edges); the cross-sectional area of the mold form is determined by that slot line of the sheet which cooperates with the sheet's tongued edge. The mold form is retained in set-up configuration by banding at spaced locations along its length, the banding serving to force the tongues fully into the slots, to prevent the form from unwrapping out of columnar configuration, and to reinforce the flexible material in columnar configuration. Further, visual indicia is provided on the sheet, and is adapted to cooperate with a port in the sheet when it is rolled into columnar configuration, to indicate the cross-sectional area of the erected mold form.

19 Claims, 14 Drawing Figures

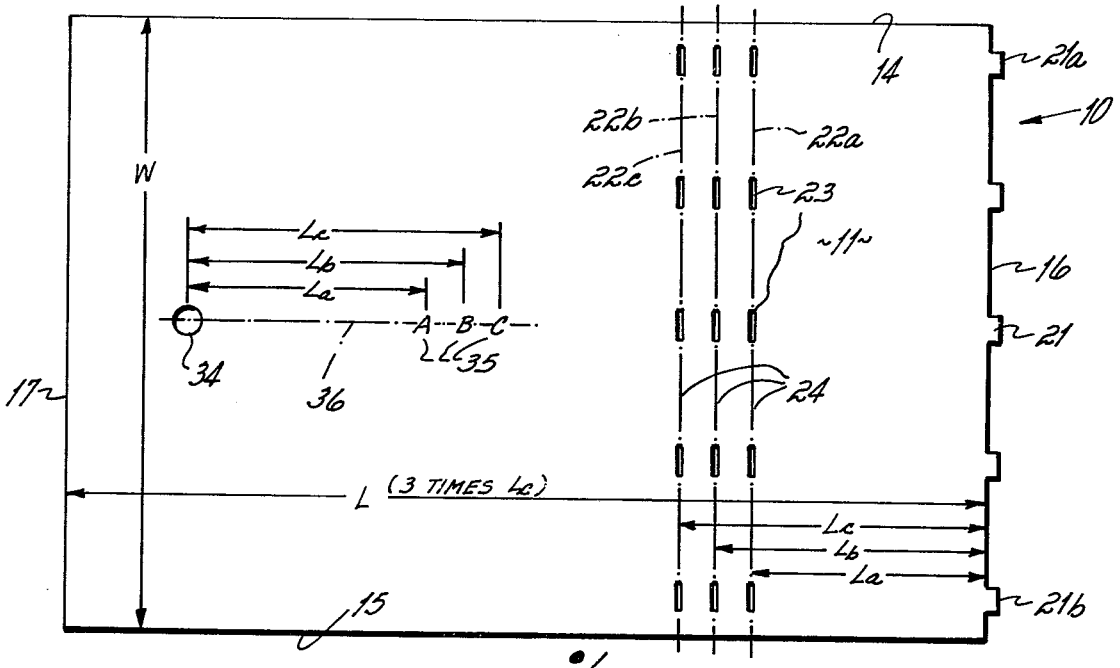
Fig. 1
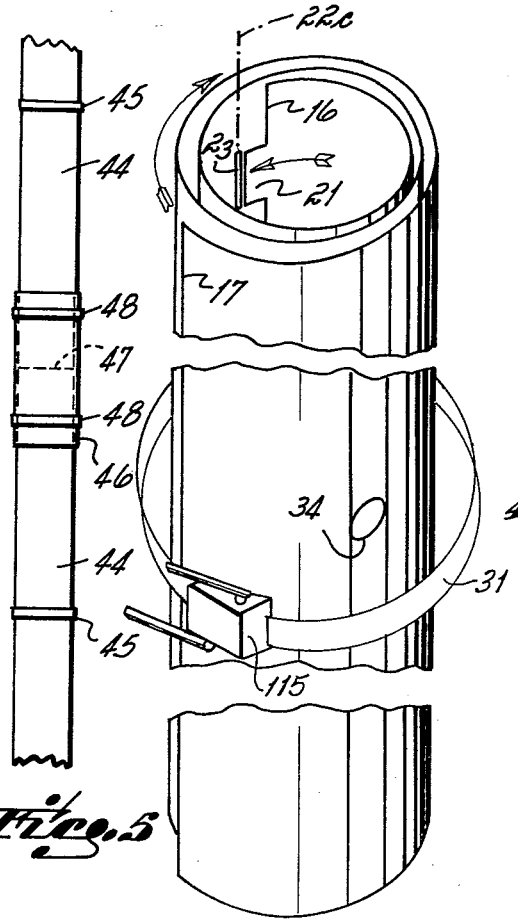
Fig. 5
Fig. 2
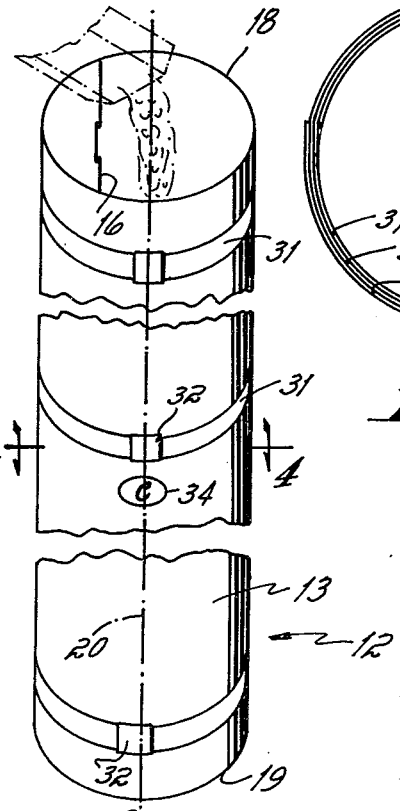
Fig. 3
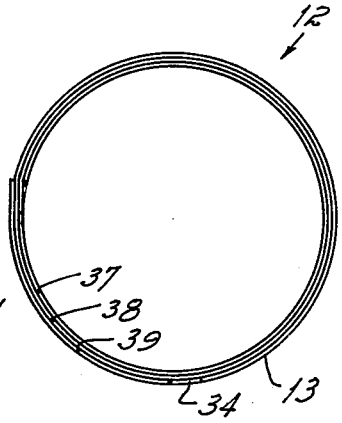
Fig. 4
INVENTOR.
BY Joseph O. Ellis
Wood, Herron and Evans
ATTORNEYS

METHOD AND APPARATUS FOR CASTING A CONCRETE COLUMN

This application is a continuation-in-part application based on U.S. application Ser. No. 379,368, filed July 16, 1973, now abandoned. U.S. application Ser. No. 378,368 is a continuation-in-part application based on U.S. application Ser. No. 347,445 filed Apr. 3, 1973, now abandoned. U.S. application Ser. No. 347,445 is a continuation-in-part application based on U.S. application Ser. No. 162,573, filed July 14, 1971, now abandoned.

This invention relates to column molds, and more particularly, relates to a column mold particularly adapted for use in casting concrete pillars or columns.

The use of concrete columns in the building and construction industry is, of course, very well known. The erection of such concrete columns has been accomplished in the past by building a wooden form into which the concrete is poured and allowed to set up; the form is, of course, removed from the column after the cast concrete has set up. Such wooden forms are relatively difficult and expensive to fabricate, particularly when it is desired that the columns have a circular cross-sectional configuration.

It is also to provide prefabricated forms of metal, and such may be particularly useful in those cases where the columnar cross-sectional configuration is circular, elliptical or the like. But such forms are relatively expensive to fabricate in the first instance, and generally such forms also require specialized clamping mechanisms to insure that the mold form's joints are fluid tight when it is set up. Further, and in the case of columns having a circular cross-sectional area, it has even been proposed that such molds be fabricated of high strength paper. However, generally speaking, the use of such paper molds has not become widely accepted because of the adherance of the paper to the set up concrete, i.e., removal of the paper that defines the columnar mold is relatively difficult once the concrete column has set up after being cast.

Generally speaking, and so far as I am aware, no prefabricated column mold known to the art is readily and easily adaptable to provide a series of molds of differing cross-sectional areas. Prefabricated column molds available are such that a completely different mold must be employed for each different cross-sectional configuration desired, and for each different cross-sectional area desired. Such is, of course, true with the wooden and metal form type molds discussed above. This tends to increase the inventory requirements of construction companies and, of course, also tends to increase construction costs.

The reusable column mold of this invention is directed to a sheet of flat, flexible material which can be rolled into columnar configuration to erect the mold form and which can be readily stripped from a set-up concrete column cast into the mold form. In one preferred form, the flat sheet is of a rectangular configuration and is characterized by a plurality of tongues on one side edge, which, when the sheet is rolled into columnar configuration, are adapted to fit into slots in the sheet located on one of a series of slot lines (the slot lines are parallel to the sheet's tongued side edge and are positioned intermediate the sheet's side edges); the cross-sectional areas of the mold form is determined by that slot line of the sheet which cooperates with the sheet's tongued edge. The mold form is retained in set-up configuration by bending at spaced locations along its axial length, the banding serving to force the tongues fully into the slots, to prevent the form from unwrapping out of columnar configuration and to reinforce the flexible material in columnar configuration. Further, visual indicia is provided on the sheet, and is adapted to cooperate with a port in the sheet when it is rolled into columnar configuration, to indicate the cross-sectional area of the erected mold form.

Thus, it has been one objective of this invention to provide a concrete column mold, and method of erecting same, from a flexible flat sheet having a plurality of tongues on one side edge of the sheet and a plurality of slots within the sheet to receive the tongues when the sheet is rolled into columnar configuration to assure a constant cross-sectional area along the height of the column mold, the sheet being of a length sufficient to provide at least about two complete wraps when in columnar configuration, thereby providing a frictional interrelationship between wraps that materially aids in maintaining a set up column's cross-sectional area, i.e., that tends to prevent the set-up mold from upwrapping, when concrete is cast therein.

It has been another objective of this invention to provide a concrete column mold, and method of erecting same, from a flexible, flat sheet which is of a length sufficient to provide at least about two complete wraps when in columnar configuration, thereby providing a frictional interrelationship between wraps that materially aids in maintaining a set up column's cross-sectional area, i.e., that tends to prevent the set-up mold from unwrapping, when concrete is cast therein, the sheet being characterized by at least one tongue on the outside face of and along one side edge of the sheet and a groove formed on the outside face of and disposed intermediate the side edges of the sheet, the tongue and groove being structured so that a butt joint is provided when the sheet is rolled into columnar configuration, thereby insuring a relatively seam-free concrete column.

It has been yet another objective of this invention to provide a concrete column mold, and method of erecting same, from a flexible flat sheet that is adapted to have any one of at least two different cross-sectional areas of a regular geometry, the mold being retained in set-up configuration by a series of tensioned clamps at spaced locations along its axial length for maintaining the form in predetermined columnar cross-sectional configuration and preventing unwrapping of the sheet out of columnar configuration.

It has been still another object of this invention to provide a novel alignment ring for use with a concrete column mold adapted to be formed into either one of at least two mold forms of different cross-sectional areas, the alignment ring being operable with the form regardless of which set-up cross-sectional area the mold form takes to aid in plumbing the mold form.

It has been a further objectivie of this invention to provide a novel splicing device for use with concrete column molds, the splicing device serving to orient and maintain two column molds stacked one on top the other in coaxial and leakproof relation one with the other.

It has been still a further objective of this invention to provide a column mold adapted to be formed into a series of mold forms of different cross-sectional areas which includes structure that presents visual indicia to the observer, once the mold form is erected, for determining the cross-sectional area of that mold form.

Other objectives and advantages of this invention will be more apparent from the following detailed description taken in conjunction with the drawings in which:

FIG. 1 is a top view of the reusable column mold of this invention showing the mold in knocked down or sheet form;

FIG. 2 is a perspective view of the column mold illustrated in FIG. 1 during assembly into columnar configuration, i.e., during rolling of the flat sheet into a cylindrical mold form;

FIG. 3 is a perspective view similar to FIG. 2 but showing the column mold in cylindrical mold form preparatory to receiving a charge of concrete material;

FIG. 4 is a cross-sectional view taken along line 4—4 of FIG. 3;

FIG. 5 is a side view similar to FIG. 3 showing the use of two mold forms assembled together to provide a mold form of increased height;

Figure 6:
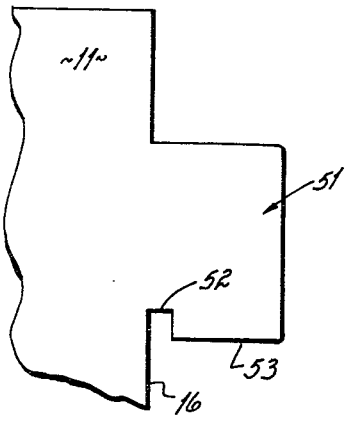
FIG. 6 is an enlarged view of an alternative tongue or tab structure.

The column mold illustrated in FIG. 1 is particularly adapted to be formed into a series of mold forms of cylindrical configuration, each of which has a different cross-sectional area. The column mold 10 is comprised of a flexible sheet 11 that is of a rectangular and planar configuration when in the flat or knocked down attitude, i.e., no protuberances or the like extend out from the front or back faces of the mold sheet 11. The flexible sheet 11, when it is desired to provide a mold form 12, is rolled up from the flat attitude (shown in FIG. 1) to the mold form 12 attitude (shown in FIG. 3). This permits the planar flexible sheet 11 to be economically stored and transported either as a series of flat sheets one on top the other or as a series of sheets rolled up into a cylindrical configuration. The sheet 11 material preferably has the characteristic of being easily strippable from the cast concrete once same has set up inside the mold form 12. This permits the column mold 10 to be reusable time and again. Further, the sheet 11 material is sufficiently strong that the mold form's side wall 13 is self-supporting and is able to restrain a column of concrete material poured therein. This allows the mold form 12 to be held in mold configuration through use of a simple strapping expedient as is explained below. Further, the sheet 11 material preferably provides a relatively smooth surface so that the cast concrete column is provided with a relatively smooth surface, too, when the sheet material is stripped or removed from the cast column. Reinforced fiberglass sheeting has been found particularly useful as a sheet 11 material. However, thermoplastic sheetings of acrylonitrile-butadiene-styrene (known to the trade as ABS) is also particularly useful. An ABS sheeting of 0.050 inch thickness is presently preferred, the ABS being that sold under the trade name Cryolar GSE by Marbon Corp., Washington, W.V., 26181.

As seen particularly from FIG. 1, the flexible, flat sheet 11 is provided with a top edge 14, a bottom edge 15, and two side edges 16, 17, the edges 14, 16 and 15, 17 being perpendicular one to the other to provide a sheet that is substantially rectangular in configuration. Of course, the top 14 and bottom 15 edges are parallel one to the other, and this results in top 18 and bottom 19 edges of the mold form 12 each of which lies in a plane that is transverse to the axis 20 of the mold form.

Figure 11:
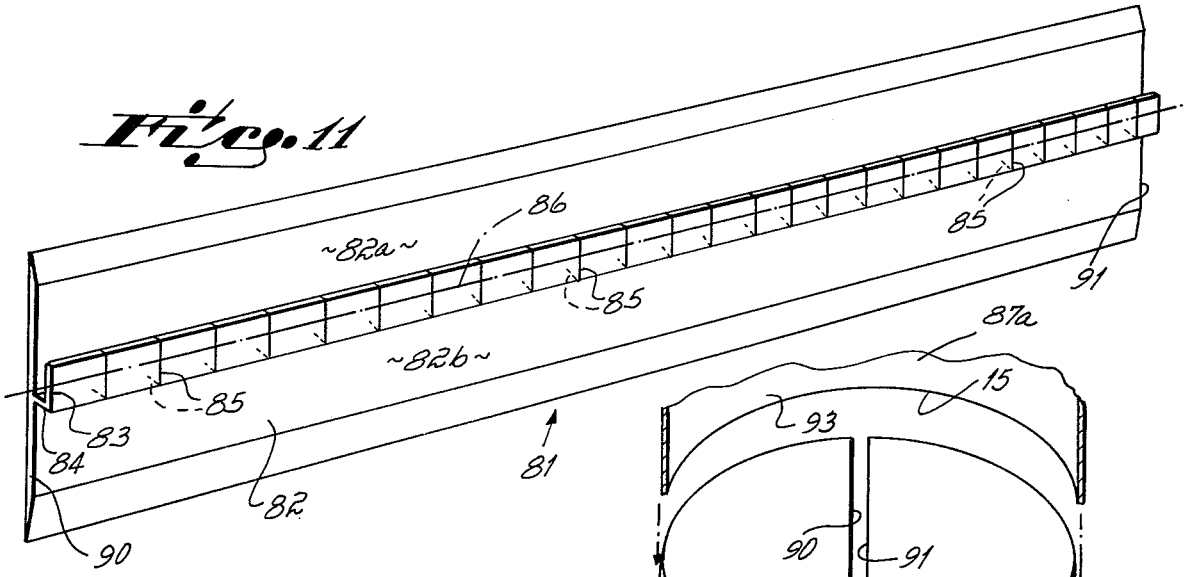
FIG. 11 is a perspective view illustrating a novel splicing device for use with set-up column mold forms.

Side edge 16 is provided with a series of tongues or tabs 21 along its length extending from the top 14 to the bottom 15 edge of the sheet 11. The tongues 21 are equally spaced one from the other from top 14 and bottom 15 edge of the sheet 11; but note that neither the uppermost tongue 21a or the lowermost tongue 21b is flush with, i.e., is partially defined by, the sheet's top 14 and bottom 15 edges. Three separate slot lines indicated by centerlines **22*a*, 22*b*, 22*c*, are located on the sheet 11 between the sheet's side edges 16, 17. Each slot line 22*a*, 22*b*, 22*c* is parallel to the other, and all the slot lines are parallel to the tongued side edge 16. Each of the slot lines is provided with a series of slots 23 equal in number to the number of tongues or tabs 21 provided on the sheet's tongued side edge 16. The slots 23 on each slot line 22*a*, 22*b*, 22*c* are positioned between the sheet's top 14 and bottom 15 edges so as to present a slot on each tongue 21 of the sheet's tongued edge 16 (no matter which of the slot lines is selected for cooperation with the tongued edge) when the sheet 11 is rolled up into cylindrical configuration, see FIG. 2. Note particularly as shown in FIGS. 1 and 2, that the tongues 21 and slots 23 are, in effect, coplanar with the sheet 11 when the sheet is flat as shown in FIG. 11, i.e., no protuberances or the like extend out from the front or back faces of the mold sheet 11, thereby permitting the sheets 11** to be stacked evenly one on top the other during storage and also permitting multiple reinforcing wraps without bulges or the like when the sheet is rolled up into mold configuration.

That slot 23 structure of the sheet 11 represented by three slot lines **22*a*, 22*b*, 22*c* allows the sheet to be rolled up into three different cylindrical mold forms 12 each of which has a distinct and different cross-sectional area from the other. The maximum cross-sectional area mold form 12 is achieved by inserting the tongues 21 on the sheet's tongued edge 16 into the slots 23 of the slot line 22*c* when the sheet is rolled up (the progress of which being illustrated in FIG. 2, and the final mold form 12 being illustrated in FIG. 3). The minimum cross-sectional area mold form 12 is achieved by inserting the tongues 21 of sheet's tongued edge 16 into slots 23 of slot line 22*a*, and a cross-sectional area mold form 12 of intermediate cross-sectional area is achieved by inserting the tongues 21 into slots 23 of slot line 22*b*. As the tongues 21 of the sheet's tongued edge 16 are inserted into the slots 23 of any of the three slot lines 22*a*, 22*b*, 22*c*, the insertion thereof is limited (and, thereby, the cross-sectional area of the cylindrical mold form 12 so formed is relatively precisely defined) by virtue of the sheet's edge 16 itself abutting against that area 24 of the sheet between the slots 23, i.e., the tongue 21 and slot 23 configuration serve to limit the rolling up motion of the sheet's tongued edge 16 relative to the rest of the sheet 11. Note particularly that the cross-sectional area of the cylindrical mold form 12 so formed from the rolled up sheet 11** is directly related to the distance L*a*, L*b*, and L*c* between the sheet's tongued edge 16 and the slot lines 22*a*, 22*b*, 22*c*, respectively, as this distance is substantially equivalent to the circumference of the cylindrical mold form 12 when same is erected as illustrated in FIG. 3. Thus, in manufacturing the sheet 11 for use in forming column molds, the slot lines 22*a*, 22*b*, 22*c* (and, hence, slots 23) are located at distances L*a*, L*b*, L*c*, respectively, from the sheet's tongued edge 16 that will result in column mold forms 12 of the desired cross-sectional area.

The overall length L of the rectangular sheet 11 from side edge 16 to side edge 17 is preferably at least about twice as long as the distance L*c* from which that slot line 22*c* (which results in the largest cross-sectional area mold form 12) is located from the sheet's tongued edge 16. In FIG. 1, the overall length L of the sheet 11 is shown as three times the distance L*c*. In other words, the number of "wraps" achieved when the sheet 11 is rolled upon itself (as shown in FIG. 2) should be at least about two; in the embodiment illustrated in FIG. 1, and when the sheet is rolled upon itself, three complete wraps are provided when the tongues 21 engage slots 23 in slot line 22*c*, and three and a fracction wraps is achieved when the tongues 21 engage slots 23 in slot line 22*a*, or 22*b*. First, and because the sheet 11 is of a thickness that allows it to be readily flexible, the plurality of wraps provides a reinforcing function to the mold form's side walls 13 when it is in columnar configuration as illustrated in FIG. 3 to insure that the mold form 12 will stand upright without support, i.e., will be self-supporting, and to insure that the mold form 12 will be able to withstand the high head pressures created when concrete is cast into the mold form 12. Second, and in the case of a cylindrical mold form 12, the presence of a plurality of wraps tends to insure the columnar configuration will be, in fact, cylindrical in cross section as opposed to some cross-sectional configuration that may tend toward the elliptical. Third, the presence of a plurality of wraps eliminates any axial or side wall joint in the mold form 12 through which a fluid leak can occur once the sheet 11 is rolled up into final columnar configuration and, thereby, eliminates the necessity of special clamping devices. And fourth, the plurality of wraps allows substantial frictional forces to be developed between the wraps as concrete is poured into the mold form 12, i.e., the plurality of wraps tends to provide substantial leverage against effort of the mold form 12 to unwrap by itself once concrete has been poured into it because of the frictional forces or interrelationship developed between the wraps, thereby materially aiding in maintenance of the column's cross-sectional area during set up of the cast concrete; this means that not much tensile strength, relatively speaking, is required of straps 31 to maintain the sheet 11 in rolled up or columnar configuration as the frictional forces provide leverage that materially assists the straps in this function.

In use, and once the desired cross-sectional area for the cylindrical mold form 12 has been selected, the sheet 11 is rolled up into a multi-wrap columnar configuration as illustrated in FIG. 2 with the tongues 21 of the sheet's tongued edge 16 being inserted into the slots 23 of the selected slot line 22*a* or 22*b* or 22*c*. Once the sheet 11 has been rolled up into cylindrical configuration tension bands or, tensioned clamps (in the form of a series of straps 31) are tied or otherwise fixed around the mold form 12 to prevent the mold form from unwrapping out of the cylindrical configuration. These flexible straps 31 are spaced one from the other relative to the form's axis 20, and a sufficient number are used, to insure that the sheet 11 will retain the rolled up or columnar configuration (with the tongues 21 engaged in slots 23) when concrete is cast therein. Further, and as the straps 31 are drawn tight about the outer periphery of the mold form 12, same serve to locate in a positive manner the tongues 21 in the slots 23 until the sheet's edge 16 abuts against area 24 between the slots so as to establish the preferred predetermined cross-sectional area of the mold form. The spacing between the straps 31 increases from the bottom to the top of the mold form 12, i.e., the straps are placed closer together toward the bottom of the mold form and are placed farther apart toward the top of the mold form. This for the reason that the hydrostatic head pressure of the concrete or other material cast into the mold form 12 is substantially greater at the bottom of the mold form than it is at the top of the mold form. Thus, the straps 31 also serve to reinforce the flexible sheet 11 material in columnar configuration to insure that the mold form 12 will be able to withstand the high head pressures when concrete is cast into the mold form 12.

It has been found quite useful to use standard steel strapping as the tension bands or straps 31, such steel strapping being fixed in place with tightening means in the form of a standard banding type tool 115, i.e., a tightening device (as shown schematically in FIG. 2). A typical banding type tool 115, which tool performs both the tightening and sealing functions, is illustrated in U.S. Pat. No. 3,380,485. that applies first restrainer means in the form of seals 32 to the strapping to hold it in place. A banding type tool (of any type well known to the art) is particularly useful as the tightening means in that it is especially adapted to remove all the slack from the flexible steel strapping 31 about the outside periphery of the cylindrical mold form 12, thereby fully engaging the tongues 21 with the slots 23 and assuring the exact cross-sectional areas desired for the mold form 12 so formed, i.e., thereby forcing the tongues fully into the slots to assure constant circumference along the length of the mold and to maintain that circumference. Of course, the steel strapping 31 is also strong enough to support the mold form 12 with concrete cast into that cylindrical mold form so as to prevent the sheet 11 from unrolling back out toward the flat sheet attitude (illustrated in FIG. 1) from its rolled up and banded attitude (illustrated in FIG. 3). The straps 31 do not have to have tensile strength adequate to oppose the hydrostatic head of concrete poured into the mold form 12; rather, the straps limit the movement of the multiple wraps so that the frictional forces generated within the wraps sustain most of the load caused by that hydrostatic head. Thus, the straps 31 primarily support the mold form 12 in its erected attitude (see FIG. 3), and do not bear all the unwrapping forces created by the hydrostatic head of concrete cast into the mold form.

Figure 10:
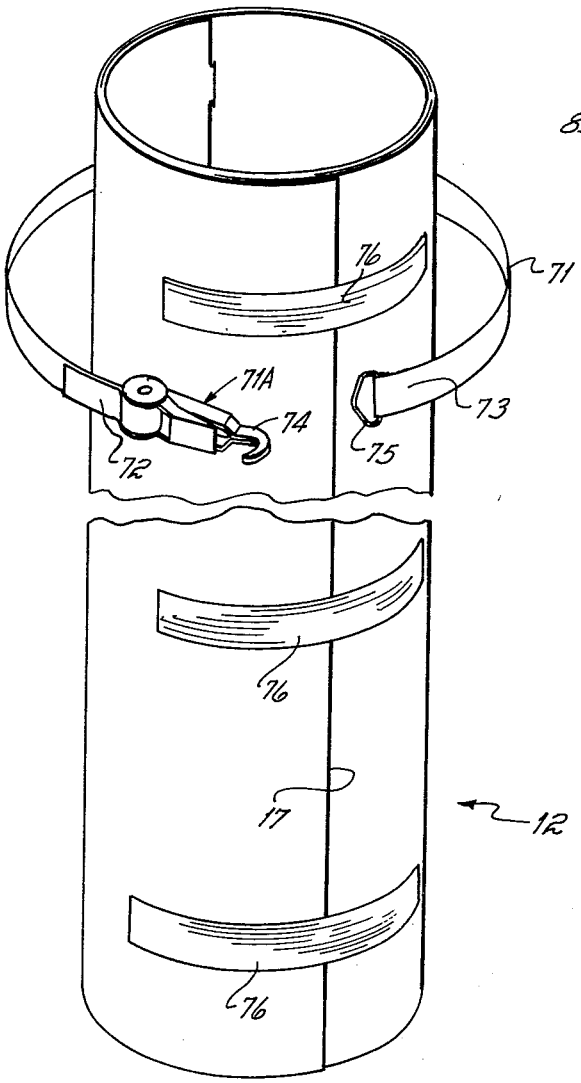
FIG. 10 is a perspective view similar to FIG. 3 but showing a different method and structure for establishing and maintaining the reusable column mold in cylindrical mold form.

An alternative to the standard steel strapping, i.e., to the straps 31, and to the standard banding type tool 115 that applies seal 32 to the strapping to hold it in place, is illustrated in FIG. 10. Such an alternative embodiment makes use of tightening means in the form of a ratchet buckle 71A i.g., a tightening device, of the type illustrated in U.S. Pat. No. 2,874,431 and U.S. Pat. No. 3,180,623, that buckle cooperating with a tension band in the form of reusable nylon web strapping 71. The nylon strapping 71 is not permanently fixed to the column mold form 12 once same is erected, but is removable therefrom along with the ratchet buckle 71A for subsequent use on other mold sheets 11 as they are erected into column mold configuration. Basically, and in this alternative embodiment, the two ends 72, 73 of the nylon strapping are fixed together about the rolled up mold sheet 11 as by means of a hook 74 on the buckle and a delta loop 75 fixed to those ends respectively. The ratchet buckle 71A is operatively connected with the strapping adjacent the end 72. The ratchet buckle 71A is than operated to draw the nylon webbing or strapping tight about the rolled up mold sheet 11, thereby positively locating the slots 23 and the tongues 21 in full interengagement, and removing all slack from the wraps of the rolled up mold sheet, to establish the mold sheet in the column mold 12 configuration. When all the slack has been taken out of the nylon webbing 71 (thereby assuring the exact cross-sectional area desired for the erected mold form), second restrainer means in the form of fiber reinforced pressure sensitive adhesive tape straps 76 i.e., restrainer straps are disposed at spaced locations along the height of the mold form overlapping the free edge 17 thereof while the nylon banding 71 retains the sheet 11 in mold form configuration, see FIG. 10. The spaced intervals of these straps 76 is much the same as for the banding 31 in the FIG. 3 embodiment. These adhesive tape straps 76, in effect, provide the restraint function of the steel strapping 31 discussed in the FIG. 3 embodiment in that they hold the mold sheet 11 in the rolled up or mold form 12 configuration, i.e., in that they prevent the mold sheet from unwrapping out of the mold form 12 configuration. In other words, only enough adhesive tape straps 76 need be used so as to prevent the sheet 11 from unrolling back out of the mold form 12 attitude illustrated in FIG. 10 to the flat sheet 11 attitude illustrated in FIG. 1. Also as illustrated in FIG. 10, the adhesive tape straps 76 need not fully surround the set up or final mold form 12 configuration. The adhesive tape straps 76 do not have to have tensile strength adequate to oppose the hydrostatic head of concrete poured into the mold form itself; rather, the adhesive tape straps 76 primarily function to limit movement of the column wraps relative one to the other so that the frictional force generated between the wraps sustain most of the load caused by that hydrostatic head. A preferred filament reinforced adhesive tape found particularly useful in connection with this invention bears product No. Y-883, and is marketed by the Industrial Tape Division, Minnesota Mining and Manufacturing Co., St. Paul, Minn. This tape is constructed of a polyester film backing having a rubber resin adhesive, and is reinforced with synthetic filaments; this tape's tensile strength is claimed to be 450 lbs. per inch width, its adhesive to steel is claimed to be 70 oz. per inch width, and it is moisture resistant. Once the adhesive tape straps 76 are in place, the ratchet buckle 71A and nylon strapping 71 may be removed and used in setting up another mold form 12, i.e., the ratchet buckle 71A and nylon strapping 71 are not required to be in operational relation with the column mold as concrete is cast therein after the straps 76 have been applied to the rolled up sheet 11. The filament reinforced adhesive tape straps 76 are desirable under certain use conditions because they are simpler to use, and because they are less expensive to use, than steel banding 31.

An alternative embodiment of the tab or tongue 21 structure is particularly illustrated in FIG. 6. Note that the alternative tab 51 structure has the same general configuration as the tab 21 structure. The difference is that the alternative tab 51 structure incorporates a bayonet-type notch 52 in its bottom edge 53 immediately adjacent the side edge 16 of the sheet 11. This notch 52 cooperates with the tab's corresponding slot 23, the notch more or less functioning as a latch to insure that the tab does not pull out of its corresponding slot (once it has been initially placed in relation therewith) while the sheet 11 is being rolled up into columnar mold configuration. That is, and without the notch 52 structure illustrated in the alternative tab 51 embodiment, the tabs 21 tend to pull out from the slots 23 as the sheet 11 is rolled up into columnar configuration prior to embracing the column mold with bands 31; the notch 52 or bayonet-type latch structure prevents that problem from occuring and makes it easier for the erector of the mold to hold the sheet in rolled up configuration while the bands 31 are applied.

The sheet 11, as illustrated in FIG. 1, is also provided with a pointer in the form of a port 34 toward the sheet's nontongued side edge 17, i.e., in that area of the sheet not between the slot lines **22*a*, 22*b* and 22*c* and tongued edge 16. The port 34 is in the nature of a hole through the sheet 11, and is adapted to cooperate with visual indicia 35 located on an indicia centerline 36 that is parallel to the top 14 and bottom 15 edges of the sheet. The visual indicia 35 (which is printed or painted or otherwise affixed onto the sheet 11) relates to the cross-sectional areas of the different mold forms 12 capable of being formed from the sheet 11 through use of the tongues 21 and slots 23 on the different slot lines 22*a*, 22*b* and 22*c*. Because the sheet 11 is particularly adapted for erecting mold forms 12 of a cylindrical cross-section, the visual indicia 35 may be in terms of square inches or square feet of cross-sectional area, or in terms of inches or feet of diameter, or the like. Further, any particular code adapted to indicate the cross-sectional area of the mold form 12 erected, e.g., the letters A, B, and C as illustrated in FIG. 1**, may be used in combination with a chart that translates the code into, e.g., square inches of cross-sectional area or inches of diameter.

The visual indicia 35 is located on the sheet 11 between the port 34 and the slot lines **22*a*, 22*b*, 22*c* and is located on line 36 a distance from the port which is directly proportional to the circumference of the cylindrical mold form 12 after same has been erected. Further, the visual indicia 35 must be located on the outside of the sheet 11 such that the port 34 can overlie same when the sheet is rolled up into the cylindrical mold form 12. In the instance of the sheet 11 shown in FIG. 1, therefore, the inside wrap 37 of the cylindrical mold form 12 is formed by that sheet section between the tongued edge 16 and the slot lines 22*a*, 22*b*, 22*c*, the second wrap 38 of the mold form 12 includes the visual indicia 35, and the third wrap 39 of the mold form 12 defines the pointer or port 34 which overlies the indicia on the second wrap. Not only does the overlying of the port 34 with the indicia 35 when the sheet 11 is in mold form 12 indicate the cross-sectional area or other parameter of the column to be cast, but same also indicates that all slack has been removed from the form 12 as the strapping or bands 31 are placed therearound. That is, the port 34 and the indicia 35 also cooperate to indicate to the mold form 12 set-up man that the tongues 21 have been fully engaged with the slots 23 in one of the slot lines 22***a*, 22*b*, 22*c*, and that all slack has been removed from the wraps 37–39 of the mold form 12, thereby providing a tight, circular cross-sectional mold form.

The height of the mold form 12 is, of course, dependent upon the width W of the sheet 11 between the top edge 14 and the bottom edge 15. If a cast column is to be of a height greater than the width W of the sheet 11, two forms 44 need merely be positioned one on top the other in coaxial alignment as indicated in FIG. 5. Of course, each of the mold forms 44 is comprised of a rolled up sheet 11, and is fixed into columnar configuration by means of strapping 45 with a standard banding tool prior to being positioned one on top the other in axial alignment. Once the mold forms 44 are so positioned one on top the other, a sleeve 46 is wrapped around the joint 47 between the two mold forms and strapping 48 is positioned above and below that joint by means of a standard banding tool. This restrains the sleeve 46 in wrapping relation about the stacked mold forms 44 so as to hold them in stacked configuration one on top the other, and so as to seal the joint 47 and prevent leakage of concrete or other material cast into the extended height column form.

Figure 12:
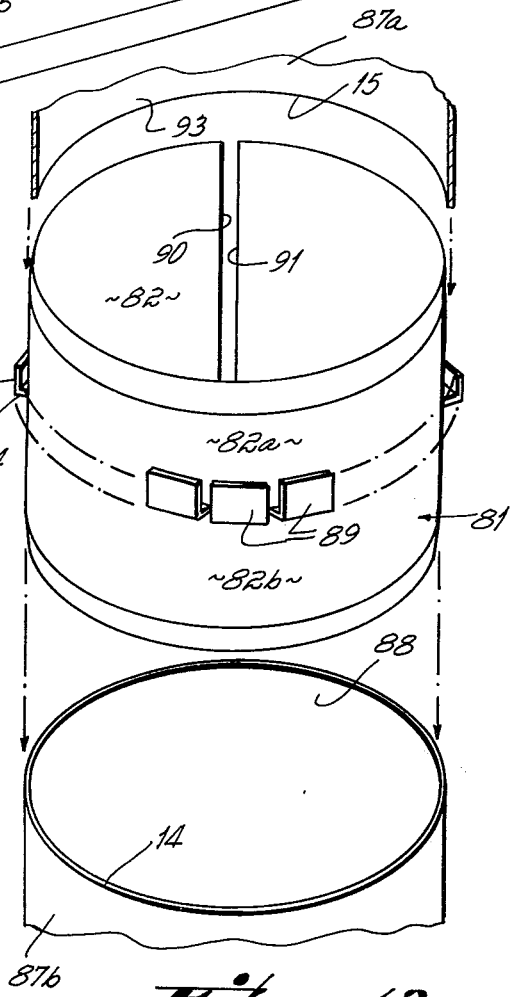
FIG. 12 is a perspective view illustrating assembly of upper and lower set-up columns mold forms into connected, stacked relation through use of the novel splicing device.

An alternative splicing device 81 by which upper and lower mold forms of the same cross-sectional area and configuration can be stacked one on top the other is illustrated in FIGS. 11 and 12. The novel splicing device illustrated in those Figures is particularly adapted for use with mold sheets 11 of this invention which have already been rolled up into column mold 12 configuration as illustrated in FIGS. 3 and 10. The novel splicing device 81 itself is generally channel-shaped in cross-sectional configuration. The inner side wall 82 of the channel is of substantially greater width than the outer side wall 83 of the channel, the two side walls being maintained in spatial relation one with the other, and connected together, by means of the channel's floor 84. As illustrated in FIG. 11, the height of the inner side wall 82 of the channel-shaped device 81 is about eight times greater than the height of the outer side wall 83 of the device 81. Note further that the outer side wall 83 of the splicing device 81, as well as the floor 84 of the device is provided with a series of slits 85 spaced one from the other along the length thereof and disposed parallel one to the other, the slits being disposed transverse to the longitudinal axis 86. No slits or cuts of any kind are provided in the inner side wall 82. When the splicing device 81 is to be used in connection with the mold sheet illustrated in FIG. 10, the device should have a length along axis 86 slightly less than the length La of the sheet 11. As noted, the novel splicing device 81 is straight as initially fabricated, i.e., is manufactured with a linear axis 86 with the side walls 82, 83 being straight from one end thereof to the other and parallel one to the other. Such can be readily accomplished by continuous extrusion of the device 81 with a cutoff saw blade (not shown) being employed to cut the continuously extruded length to the desired length, and to provide the slits at selected spaced intervals along the splicing device's side wall 83 and floor 84. The device 81 may be extruded from a polyvinyl compound material that maintains its extruded configuration but has a degree of bending flexibility such as rigid extrusion compound 8700A as marketed by B. F. Goodrich Chemical Co., a division of The B. F. Goodrich Co., 3135 Euclid Ave., Cleveland, Ohio 44115.

When it is desired to stack an upper mold 87*a* on top of a lower mold 87*b* (such molds having been previously erected from identical mold sheets 11 as shown in FIG. 1 into mold forms 12 of the same cross-sectional area and configuration), the novel splicing device 81 illustrated in FIG. 11 is curved into a generally circular or tubular configuration with the inner wall of that configuration being the wide wall 82 of the splicing device, see FIG. 12. Of course, the inner wall 82 of the splicing device can be so curved into general conformity with the curvature of the inner face 88 of lower mold form 87*b* because the slits 85 in the splicing device's outer side wall 83 and floor 84 permit the separation of those component elements into a series of spaced brackets 89. In this attitude, and as illustrated in FIG. 12, the splicing device's floor 84 is simply seated on the top edge 14 of the lower mold form 87*b* with the splicing device's lower inner wall 82*b* extending downwardly into, and lying flush against the inner face of, the rolled up lower mold form itself, thereby locating the splicing device in operating relation with the lower mold form 87*b*. Since the splicing device 81 has a linear attitude as manufactured and shown in FIG. 11, same tends to spring outwardly into conforming relation with the curved inner face 88 of the erected lower mold form 87*b*. Further, and since the splicing device 81 has an overall linear length less than the inner peripheral circumference L*a* which is the smallest of those peripheral circumferences L*a*–L*c* of the mold sheet 11, same can be used with the mold form no matter which of the three slot lines 22*a*–22*c* are used in conjunction with the tongues 21. If slot line 22*a* is used the transverse end edges 90, 91 of the splicing device 81 will be in almost abutting engagement one with the other. But if slot line 22*c* is used the end edges 90, 91 of the splicing device 81 will be separated one from the other a slight distance about equal to the difference of Lc minus La; from a practical standpoint this will not render the device 81 inoperable.

Once the splicing device is seated on top the lower mold form 87*b*, it is ready to receive the upper mold form 87*a*. The brackets 89 formed by the outer side wall 83 and floor 84 cooperate together to function as an annular seat for the lower edge 15 of the upper mold form 87*a*, i.e., the annular seat is disposed on the top edge 14 of the lower mold form 87*b*. Thus, when the upper mold form 87*a* is slid downwards over the splicing device's upper inner wall 82*a* (which extends substantially above the lower mold form's upper edge 14), the upper mold form 87*a* is seated on the brackets 89, thereby causing the upper inner wall 82*a* of the splicing device 81 to extend upwardly into and flush against the inner face 93 of the upper mold form. Since the inner wall 82 of the splicing device 81 extends upwardly into the upper mold form and downwardly into the lower mold form when those mold forms are in final operative or seated relation with the sealing device the inner wall 82 functions as a sealing face which closes off the joint (as shown at 47 in the FIG. 5 embodiment) where the upper and lower mold forms meet one another. Thus, a relatively fluid-tight joint is provided which prevents concrete from leaking out when concrete is so poured into the stacked mold forms 87*a*, 87*b*.

Figure 7:
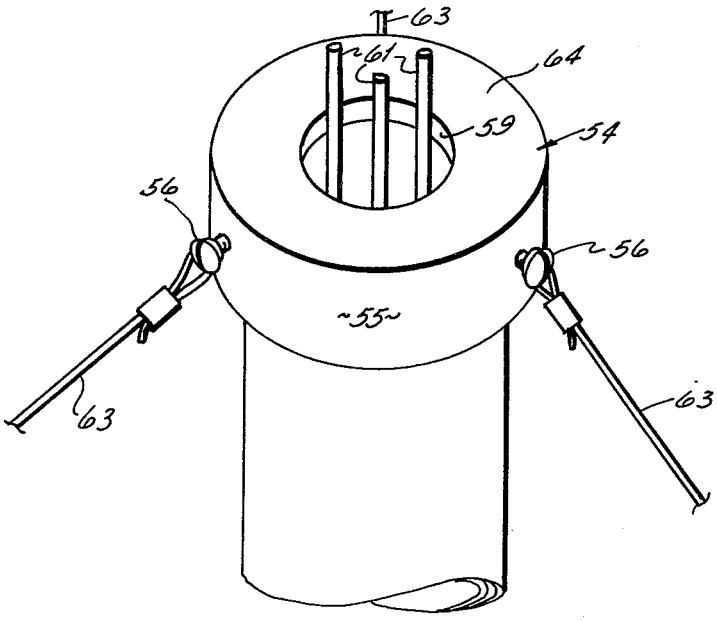
FIG. 7 is a perspective view illustrating use of the column mold in operative relation with a novel alignment ring.
Figure 8:
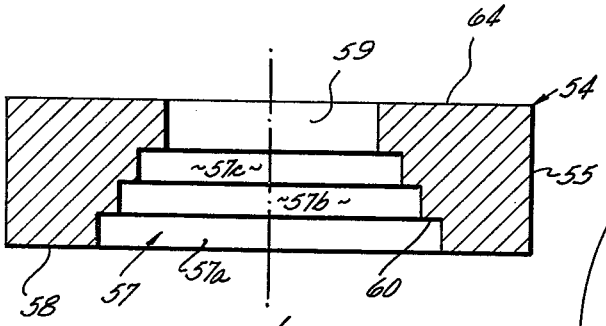
FIG. 8 is a cross-sectional view of the alignment ring taken along a diameter thereof.
Figure 9:
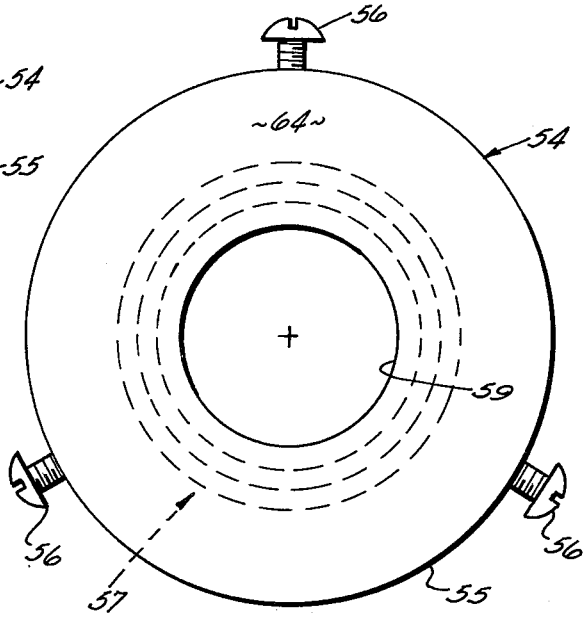
FIG. 9 is a top view of the alignment ring.

An alignment ring 54 particularly adapted for use with the reusable column mold of this invention is particularly illustrated in FIGS. 7–9. The alignment ring 54, as illustrated in the Figures, is of a circular outer periphery 55, and includes three bolts 56 fixed thereto that extend radially outward from the outer periphery. The bolts 56 are spaced at 120° one from the other around the external periphery. The alignment ring 54 is also provided with a series of differing diameter circular seats 57*a*–57*c* that are concentric relative one to the other, and concentric relative to the outer periphery 55 of the alignment ring. The seats 57 are in a tier or pyramid-like configuration that extends inwardly from the ring's bottom face 58. A hole 59 of a diameter less than the diameter of the smallest diameter seat 57*c* is also provided in the alignment ring 54, thereby making the ring generally doughnut-shaped in configuration.

Each of the annular seats 57*a*–57*c* is of a different diameter from each of the other seats, the widest diameter seat 57*a* being sized to cooperate with the column mold when it is rolled up into that mold form configuration having the greatest diameter, i.e., into that mold form configuration where slots 23 in slot lines 22*c* cooperate with tabs 21. The intermediate diameter 57*b* seat is sized to allow seating of the alignment ring on top the column mold when the column mold is rolled up into mold form configuration of intermediate size, i.e., into that mold configuration where slots 23 in slot line 22*b* cooperate with tabs 21. The small diameter annular seat 57*c* allows the alignment ring 54 to be seated on top the column mold when the sheet 11 is rolled up into mold form configuration of the smallest diameter, i.e., when tabs 21 cooperate with slots 23 on slot line 22*a*. For example, and when the mold form configuration is of maximum diameter, the floor 58 of the seat rests on the top edge 18 of the rolled up mold form 12, and the annular side wall 61 of the seat constrains the mold form in perfectly annular configuration at the top thereof.

In use, the alignment ring is seated onto a rolled up mold form 12 as illustrated in FIG. 7. In this seated attitude the reinforcing rods 61 for the prospective concrete column extend upwardly through the column mold form 12, and out the concentric hole 59 provided in the top face 64 of the alignment ring 54. Further, the hole 59 in the top face of the alignment ring allows concrete to be poured or cast into the mold form itself; note FIG. 3. When in the attitude illustrated in FIG. 7, guide wires 63 may be fixed to the stud bolts 56 mounted on the outer periphery 55 of the alignment ring 54. These guide wires 63 are then staked to the ground by suitable stakes, not shown. The guide wires 63 are then adjusted by turnbuckles (not shown) or the like until the mold form is precisely plumb relative to ground level. Thus, a single alignment ring 54 can be provided with a single column mold sheet 11, the alignment ring being adapted for use with all of the series of cross-sectional areas for which the sheet itself is adapted to be configured.

Figure 13:
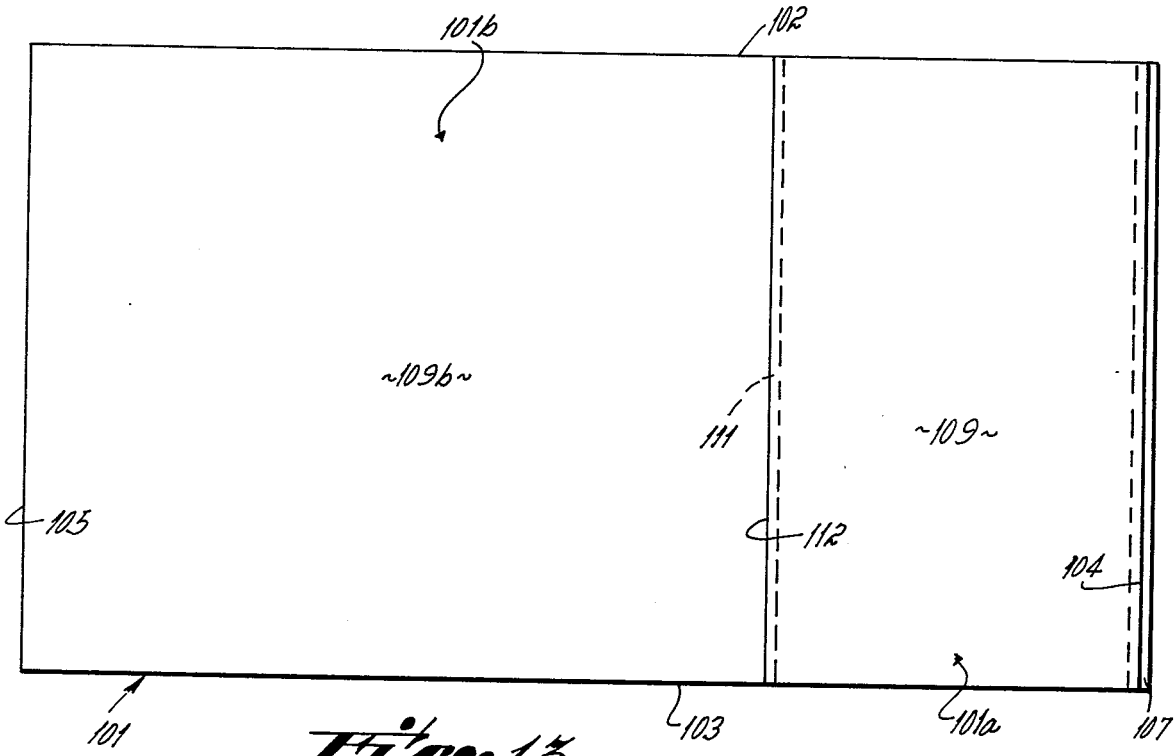
FIG. 13 is a view similar to FIG. 1 showing another embodiment of the invention.
Figure 14:
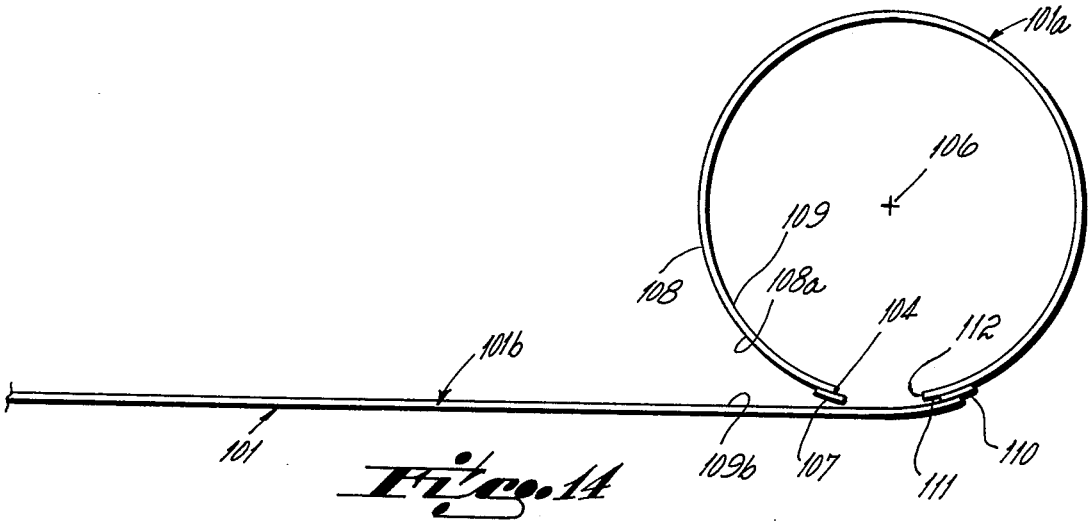
FIG. 14 is a top view of that mold sheet shown in FIG. 13 during assembly thereof into column mold configuration.

Another embodiment of a reusable column mold in accord with certain principles of this invention is illustrated in FIGS. 13 and 14. The reusable column mold sheet 101 illustrated in these Figures is adapted to provide a column mold of only a single cross-sectional area, i.e., it is not capable of providing two or more column molds of different cross-sectional areas as is the case with that column mold sheet 10 illustrated in FIG. 1. In accord with the column mold sheet 101 structure illustrated in FIG. 13, same is comprised of a flexible sheet that is of rectangular and planar configuration when in the flat or knocked down attitude. The column mold sheet 101 illustrated in FIG. 13 preferably is of the same physical characteristics as described for that column mold sheet illustrated in FIG. 1, the primary difference being directed to the structural means by which the correct cross-sectional area of the column mold is achieved. The flexible flat sheet 101 is provided with a top edge 102, a bottom edge 103, and two side edges 104, 105 that are oriented one to the other so as to provide a sheet that is substantially rectangular in configuration. Of course, the top 102 and bottom 103 edges are parallel one to the other, and this results in top and bottom edges of the mold form each of which lies in a plane that is transverse to the axis 106 of the mold form.

Side edge 104 is provided with a single tongue 107 that extends along its length from the top edge 102 to the bottom edge 103 of the sheet 101. This tongue 107 is in the nature of a continuous strip fixed to the outside face 108 (as opposed to the inside face 109) of the mold sheet, the tongue extending slightly beyond the side edge 104 of the sheet. While the sheet 101 is in the nature of a single piece from a structural standpoint, it is fabricated from two separate sheets 101*a*, 101*b* fixed together intermediate the side edges 104, 105 of the sheets by a spacer strip 110. The first section 101*a* of the sheet is of a length that provides the column mold with the desired cross-sectional area after same has been set up. The length of the second section 101*b* of the sheet is at least sufficient to provide at least about one further complete wrap when the sheet has been set up in columnar configuration and, as shown in FIG. 14, is of a length sufficient to provide about two more complete wraps. Thus, the FIG. 14 embodiment provides three complete wraps for the column mold when same is set up in columnar configuration, thereby providing a frictional interrelationship between wraps that materially aids in maintaining the set up column's cross-sectional area, i.e., that tends to prevent the set up mold from unwrapping, when concrete is cast therein. Note that the fixed relationship of the sheet's first section 101*a* with the second section 101*b*, as accomplished through the spacer strip 110 that runs from the top edge to the bottom edge of the sheet, is structured so as to present a slot or groove 111 between the outer face 108*a* of the first section 101*a*, and the inner face 109*b* of the second section 101*b*. This groove 111 is sized to receive the tongue 107 fixed to edge 104 of the sheet 101.

In use, and as is illustrated particularly in FIG. 14, the first section 101*a* of the sheet is preliminarily oriented in columnar configuration and the tongue 107 inserted in the groove 111 defined by the spacer strip 110, the first section 101*a* and the second section 101*b*. When the tongue 107 has fully seated within the groove 111, leading edge 104 of the first section 101*a* abuts against trailing edge 112 also of that first section, thereby providing a butt joint that, in effect, provides a continuous or seamless inner surface 109 for the column mold itself. This seamless inner surface 109 for the erected column mold contrasts with the seam 16 inner surface of the FIG. 1 embodiment as shown in FIGS. 3 and 4. Of course, under certain construction considerations it is highly desirable to have a column mold which, after the concrete has been cast therein and the mold stripped from the column, leaves a circular concrete column with substantially no seam lines at all for aesthetic purposes.

After the edges 104, 112 of the first section 101*a* have been butted together, i.e., after the tongue 107 has been received in the groove 111 defined between the first 101*a* and second 101*b* sections, the second section is then wrapped about the first section to provide multiple wraps as is discussed above in connection with the FIG. 1 embodiment. Subsequently, the column mold may be retained in the set-up configuration by means of the steel strapping 31/seal 32 approach as discussed in connection with FIGS. 3 and 5, or may be retained in column mold configuration by the ratchet buckle 71*a*/adhesive tape 76 approach as discussed in connection with FIG. 10, during casting of concrete therein.

While this invention has been described in conjunction with a reusable column mold particularly adapted to form a mold form 12 having a circular cross-sectional area, the structural concept of the reusable column mold of this invention may also be used in erecting column mold forms of square, rectangular, and elliptical configurations. Such diverse configurations can be achieved simply by wrapping inserts of the desired configuration into the sheet as same is rolled up into mold form, and thereafter applying the strapping 32 with a standard banding tool.

I claim:

1. Column mold apparatus for use in casting concrete columns, said column mold apparatus comprising a sheet of flexible material having at least one face that may be easily stripped from set-up concrete cast thereagainst, said sheet being of a length such that at least about two complete wraps are provided when said sheet is rolled into columnar configuration to erect a mold form of multi-wraps, said multi-wraps being frictionally engaged one with the other to resist unwrapping of the mold form when concrete is cast therein, at least one tongue fixed to one side edge of said sheet, at least one slot formed in said sheet to receive said tongue when said sheet is rolled into columnar configuration, said slot being located on at least one slot line parallel to the sheet's tongued side edge and positioned intermediate the sheet's side edges, the cross-sectional area of the mold form being determined by the distance between the slot line and the sheet's tongued edge when the sheet is rolled into the multi-wrap mold form, at least one tension band associated with said sheet, said band being of a length that allows it to be positionable at least temporarily about the entire exterior periphery of said multi-wrap mold form, and tightening means cooperatively engageable with said band to draw said band tight about the external periphery of said multi-wrap mold form for defining the desired cross-sectional area of said mold form by forcing said tongue into a full seated relation with said slot and by substantially removing any slack between said multi-wraps.

2. Column mold apparatus as set forth in claim 1 including visual indicia arranged on said sheet to indicate to the user the cross-sectional area of the mold form as erected.

3. Column mold apparatus as set forth in claim 2 including port means in said sheet that cooperates with said visual indicia when the mold form has been erected to permit viewing of said indicia by the user.

4. Column mold apparatus as set forth in claim 1, said column mold apparatus further comprising restrainer means cooperatively engageable with said tension band to retain same in a drawn-tight attitude, as provided by said tightening means, said tightening means being removable from cooperative engagement with said band after said first restrainer means has been engaged therewith, thereby maintaining said tongue in full seated relation with said slot and the slack between said multi-wraps substantially removed to insure that the desired cross-sectional area of said multi-wrap mold form is maintained during the casting of concrete into said form.

5. Column mold apparatus as set forth in claim 4, said first restrainer means comprising a seal connectable with said tension band, said seal restraining said tension band in the drawn-tight attitude after removal of said tightening means from cooperative engagement with said band, thereby preventing the set up multi-wrap mold form from unwrapping out of mold form configuration prior to casting concrete therein.

6. Column mold apparatus as set forth in claim 1, said column mold apparatus further comprising restrainer means cooperatively engageable with said sheet to retain same in a drawn-tight attitude as provided by said tightening means, said tension band and said tightening means being removable from cooperative engagement with said sheet after said second restrainer means has been engaged with said sheet, thereby maintaining said tongue in full seated relation with said slot and the slack between said multi-wraps substantially removed to insure that the desired cross-sectional area of said multi-wrap mold form is maintained during the casting of concrete into said mold form.

7. Column mold apparatus as set forth in claim 6, said second restrainer means comprising adhesive tape adapted to stick to said sheet, said adhesive tape being fixed in place on said multi-wrap mold form to prevent the set up multi-wrap mold form from unwrapping out of mold form configuration prior to casting concrete therein.

8. Column mold apparatus as set forth in claim 1, said column mold apparatus further comprising a plurality of slots in said sheet that are adapted to receive said tongue when said sheet is rolled into columnar configuration, said slots being located on at least two slot lines both of which are parallel to the sheet's tongued side edge and both of which are positioned intermediate the sheet's side edges, the cross-sectional area of the mold form being determined by that slot line of the sheet which cooperates with the sheet's tongued edge when the sheet is rolled into the mold form.

9. Column mold apparatus as set forth in claim 8, said column mold apparatus further comprising a plurality of slots disposed on each of said slot lines, and a plurality of tongues disposed on the sheet's tongued edge.

10. Column mold apparatus as set forth in claim 1 wherein said sheet is formed of a first section and a second section, said tongue being fixed to one of said sheet's first and second sections, and said sections being connected one to the other so as to define a slot therebetween, said slot and tongue being adapted to seat one within the other to permit said sections to form a substantially seamless joint for said multi-wrap column mold form when said sheet is rolled into columnar configuration.

11. A method of casting concrete columns, said method comprising rolling up a sheet of flexible material into a mold form of multi-wraps having at least about two complete wraps, said multi-wraps being frictionally engaged one with the other to resist unwrapping of the mold form when concrete is cast therein, inserting at least one tongue fixed to one side edge of said sheet into at least one slot formed in said sheet to arrange said sheet into columnar configuration of a predetermined cross-sectional area, said slot being located on a line parallel to the sheet's tongued side edge and positioned intermediate the sheet's side edges, the cross-sectional area of the mold form being determined by the distance between the slot line of the sheet which cooperates with the sheet's tongued edge when the sheet is rolled into the multi-wrap mold form, positioning at least one tension band at least temporarily about the entire exterior periphery of the multi-wrap mold form, drawing said tension band tight about the external periphery of said multi-wrap mold form for defining the desired cross-sectional area of said mold form during use by forcing said tongue into a full seated relation with said slot and by substantially removing any slack from between said multi-wraps, and thereafter casting concrete into the mold form.

12. A method as set forth in claim 11 including the step of observing separate visual indicia arranged on said sheet to indicate the cross-sectional area of the mold form as erected.

13. A method as set forth in claim 12 wherein said indicia is observed through a port in said sheet that overlies said indicia when the mold form has been erected.

14. A method as set forth in claim 11 including the further steps of restraining said tension band in a drawn-tight attitude as established in said drawing step, thereby maintaining said tongue in full seated relation with said slot and the slack between said multi-wraps substantially removed to insure that the desired cross-sectional area of said mold form is maintained during the casting of concrete into said mold form, and thereafter removing, from cooperative engagement with said bands, a tightening device previously used for drawing said tension band tight.

15. A method as set forth in claim 14, said tension band being restrained in the drawn-tight attitude by connecting a seal therewith.

16. A method as set forth in claim 11 including the further steps of applying a restrainer strap to said sheet to retain same in a drawn-tight attitude as established in said drawing step, thereby maintaining said tongue in full seated relation with said slot and the slack between said multi-wraps substantially removed to insure that the desired cross-sectional area of said mold form is preserved during the casting of concrete into said mold form, and thereafter removing at least one of said tension band, and a tightening device previously used for drawing said tension band tight, from cooperative engagement with said multi-wrap mold form.

17. A method as set forth in claim 16, said restrainer strap being in the form of adhesive tape adapted to stick to said sheet.

18. A method as set forth in claim 11, said sheet being characterized by a plurality of slots, said slots being located on at least two slot lines both of which are parallel to the sheet's tongued side edge and are positioned intermediate the sheet's side edges, said method including the further step of selectively inserting said tongue in that slot on one of said slot lines only, that slot line selected for cooperation with said tongue determining the cross-sectional area of said mold form when said sheet is rolled up into multi-wrap mold configuration.

19. A method as set forth in claim 11, said method including the further step of structuring said tongue and slot such that, when said mold sheet is rolled into columnar configuration, the multi-wrap mold form provides a substantially seamless joint at the joint of said tongue and slot.

* * * * *